United States Patent [19]

Ashbrook

[11] Patent Number: 4,711,048

[45] Date of Patent: Dec. 8, 1987

[54] ANTIPERSONNEL SHOTGUN CHOKE

[76] Inventor: Clifford L. Ashbrook, P.O. Box 13237, San Antonio, Tex. 78213

[21] Appl. No.: 18,804

[22] Filed: Feb. 19, 1987

Related U.S. Application Data

[63] Continuation of Ser. No. 695,096, Jan. 25, 1985.

[51] Int. Cl.[4] ..... F41C 21/18

[52] U.S. Cl. ..... 42/79; 239/589; 239/599

[58] Field of Search ..... 42/79; 89/14.05; 239/589, 597, 599, 601

[56] References Cited

U.S. PATENT DOCUMENTS

| | | | |
|---|---|---|---|
| 748,608 | 1/1904 | Hueni | 239/552 |
| 833,484 | 10/1906 | Robedee | 42/79 |
| 966,889 | 8/1910 | Devol | 42/79 |
| 1,352,938 | 9/1920 | Blair | 42/79 |
| 1,958,044 | 5/1934 | Hendricks | 239/419 |
| 2,098,617 | 11/1937 | Cutts | 42/79 |
| 2,167,173 | 7/1939 | Fleming | 42/79 |
| 3,226,871 | 1/1966 | Sargeant et al. | 42/79 |
| 3,378,207 | 4/1968 | Huthsing, Jr. | 239/599 |
| 3,492,750 | 2/1970 | Ashbrook et al. | 42/79 |
| 3,496,667 | 2/1970 | Lowry | 42/79 |
| 3,676,947 | 7/1972 | Ashbrook | 42/79 |
| 3,729,848 | 5/1973 | Wilhelm et al. | 42/79 |
| 4,024,790 | 5/1977 | Heiderer | 89/14.2 X |
| 4,071,195 | 1/1978 | Kuhns et al. | 239/589 |
| 4,097,000 | 6/1978 | Derr | 239/599 |
| 4,157,703 | 6/1979 | Brown et al. | 124/55 |

*Primary Examiner*—Deborah L. Kyle
*Assistant Examiner*—Ted L. Parr
*Attorney, Agent, or Firm*—Cox & Smith Incorporated

[57] ABSTRACT

A shotgun choke for deforming the shot pattern to throw a very wide pattern with a narrow vertical band by maintaining a substantially constant width in the choke but narrowing the height of the interior of the choke in a parabolic fashion.

4 Claims, 5 Drawing Figures

ANTIPERSONNEL SHOTGUN CHOKE

This is a continuation of co-pending application Ser. No. 695,096 filed on Jan. 25, 1985.

BACKGROUND OF THE INVENTION

The present invention relates to shotgun chokes. More particularly, the present invention relates to an easily installed shotgun choke for providing a pattern of shot ideal for situations involving use of a shotgun against personnel at short range.

A shotgun choke is a device well known in the art. It has been known to vary the shape and length of the barrel of the shotgun, particularly the end of the barrel, to alter the projectile path of the shot pellets after leaving the barrel of the gun. After leaving the confines of the shotgun barrel, the kinetic energy of the mass of pellets is no longer constrained from expanding in diameter, thus providing an alternative direction in which to travel besides moving forward. The kinetic energy of the mass of pellets, and ricochets from individual pellets hitting each other, will cause the mass of pellets to spread out into a larger diameter the farther it travels from the barrel within the range of the gun. Shotgun chokes are used to control the rate at which these pellets spread out and also to control the manner or "pattern" in which the pellets spread out after leaving the gun barrel. The natural pattern of this spread is circular, although it is known to use the choke to modify the shape of the pattern from a circular pattern to some other pattern to accomplish a particular purpose. For example, the device disclosed by Fleming (U.S. Pat. No. 2,167,173) discloses a shotgun barrel which contains a flared portion on a particular side of the barrel near the end. The barrel end is flared to create a bias in the pattern of shot so that a lopsided pattern is produced. The lopsidedness of the pattern is intended to compensate for a hunter which has a consistent habit of shooting above, behind, below, or above his or her target. For example, if the hunter tends to shoot under the target too often, a flare will be placed along the top of the barrel end to scatter some of the shot above the periphery of the normal circular pattern. Fleming also discloses a device with flares at both sides of the barrel end, supposedly to obtain a wider pattern. However, a mass of pellets travelling through a shotgun barrel has a fixed amount of potential kinetic energy. In order to obtain the widest possible pattern in the shortest possible distance, it is necessary to transfer some of the kinetic energy expended in dispersing the pattern vertically to the energy used to disperse the pattern horizontally. In other words, if the vertical spread of the pattern can be restricted, this will transfer energy to the horizontal forces in the pellets and increase the horizontal spread. Fleming does not vertically restrict the pellet's path, with the result being that the width of the pattern is not as wide as is capable of being achieved.

In the anti-personnel field, the user of a shotgun is generally not concerned with obtaining the maximum effective range available from the particular gauge of shotgun as in hunting situations, but, will instead be more concerned with achieving a particular pattern. For instance, a wide pattern (larger horizontally than vertically) is often desirable in situations of armed conflict, such as guerrilla warfare or a SWAT team. Because confrontations in these situations often occur at very close range, quick reactions on the part of the user of the shotgun are at a premium. There is seldom sufficient time for the user to take careful aim at a target, and he or she will only have time to fire the weapon in the general direction of the target. Thus, a pattern which covers a wide area is needed. At the same time, the effective range of the shotgun is generally not an important criteria. If the weapon is being fired by a member of a SWAT team inside of a building, the room in which the weapon is fired will generally not be more than twenty-five to forty feet long. For this reason, it is desirable that the shot pattern be able to spread as wide as possible within a twenty-five to forty foot range. In any case, the maximum effective range necessary is generally no greater than twenty-five yards.

A design limitation for shotgun chokes is that they should be capable of withstanding extremely high pressures and temperatures without significant metal fatigue. Even the slightest metal fatigue is intolerable, because chokes are expected to have a useful life equally as long as the weapon upon which they are used.

A further desirable feature of chokes is to provide a choke which can be easily attached to existing shotguns. Many shotgun chokes are designed as an integral a part of the barrel, so that the barrels must be switched out when a change in choke is desired. It is much less expensive to provide a choke which attaches to the end of the barrel of any common shotgun than to machine a choke as part of the barrel which would require the manufacture of separate barrels.

A number of shot pattern modification devices exist in the prior art. However, it is believed that they contain unsuitable limitations for use as an anti-personnel shotgun choke. The limitations of Fleming (U.S. Pat. No. 2,167,173) have already been discussed. The Applicant is a co-inventor of two related patents (U.S. Pat. Nos. 3,676,947 and 3,492,750). These devices contain a primary feature of vents to "divert" gases which are driving the shotgun pellets. While the devices disclosed are capable of throwing a relatively wide pattern, testing of the devices by the Applicant and a branch of the United States armed forces has revealed that with a twenty inch barrel and #4 buckshot, the devices will throw a pattern approximately 14¾ inches high and 35½ inches wide at 32.70 feet. As will be described later, Applicant's invention offers a much wider pattern at a similar distance. The device disclosed in Sargeant et al. (U.S. Pat. No. 3,226,871) shows a shotgun choke known as the "duck bill" choke. While this duck bill choke is capable of throwing a relatively wide pattern, it may suffer from important and unnecessary structural weakness from the notches formed in the barrel. Particularly in the duck bill design, the heat and force of a shotgun blast can cause the top or bottom or both portions of the device to crack and fly off. The device disclosed by Wilhelm et al. (U.S. Pat. No. 3, 729,848) is a hand gun for discharging specially designed shot-type ammunition which contains a wide, narrow flange for providing a linear shot pattern. Although the device claims to provide a linear shot pattern, hand guns are inappropriate for using most standard gauges of shot, such as 12 gauge, 16 gauge and 20 gauge, although a few shotgun pistols are known to exist. These shotgun pistols are, to the Applicant's knowledge, usually found in smaller gauges, such as 410 gauge and less. The large kickback of a large gauge charge makes the pistols difficult to fire, and the small size of the pistol severely limits the number of shells which may be held in the magazine.

This latter limitation is a severe limitation for anti-personnel use, as the magazine should be capable of holding a large number of shells to provide an adequate safety factor. Also, the device must be specially made and cannot be adapted to existing shotguns. Other devices for altering shot patterns are found in Lowry (U.S. Pat. No. 3,496,667), Cutts (U.S. Pat. No. 2,098,617) and Devol (U.S. Pat. No. 966,889). All of these devices alter the pattern of shot, but do so in a circular fashion, so that the vertical kinetic energy of the shot is not efficiently transferred into horizontal kinetic energy, making the width of the pattern inadequate.

Therefore, it is an object of the present invention to provide a shot pattern modification device for shotguns, otherwise known as a choke. It is an object of the present invention to provide a shotgun choke which has an extremely wide shot pattern for use as an anti-personnel weapon but which has an effective range sufficient to reach through most rooms and hallways in buildings. It is a further object of the present invention to provide a durable and safe shotgun choke. It is a further object of the present invention to provide a shotgun choke which is easily installed on most standard models of shotguns. Other objects of the invention will become evident when the invention is described hereafter.

SUMMARY OF THE INVENTION

A choke for effecting the projectile path of a plurality of projectiles fired substantially simultaneously from a weapon, comprised of wall means defining an interior space through the length of the choke, the diameter of the interior space remaining substantially constant in a first plane, but decreasing in a perpendicular second plane, beginning at a point where the choke receives the plurality of projectiles. The choke may be fixably mounted on the barrel or integrally formed on the barrel. The diameter of the second plane may decrease in a substantially parabolic fashion. Also, the invention is comprised of a method for deforming a plurality of projectiles comprising attaching a deforming means to the end of a barrel of a weapon, firing a plurality of projectiles substantially simultaneously from the weapon through the barrel, receiving the plurality of projectiles into the deforming means, deforming the projectile path of the plurality of projectiles in a first primary direction but not in a second primary direction, and releasing the plurality of projectiles into the atmosphere.

DESCRIPTION OF THE PREFERRED EMBODIMENT

Figure 1:
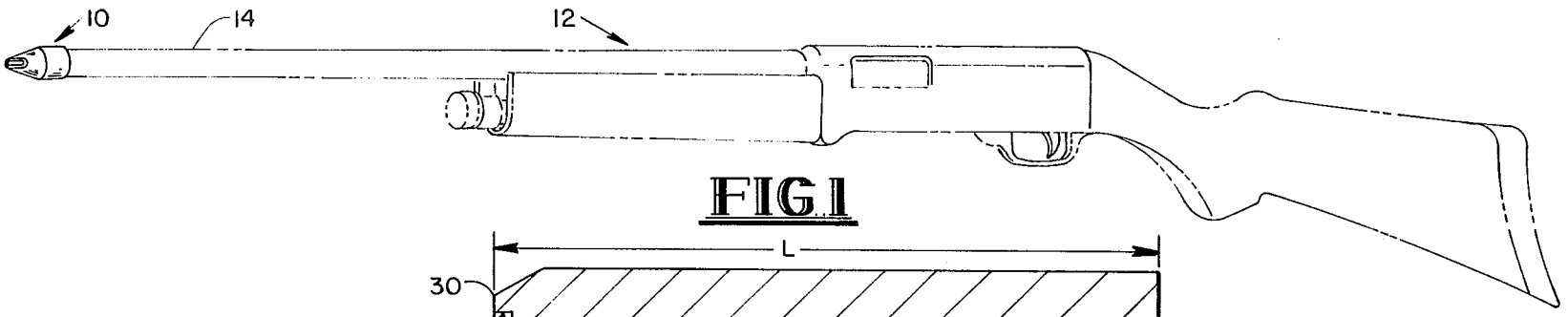
FIG. 1 is a side perspective view of the choke as attached to a shotgun.

In FIG. 1 is shown the choke 10 assembled on a standard model shotgun 12. Although it is desirable for the present invention to be manufactured in a manner capable of being added to standard model shotguns 12, it is understood that the present invention could also be manufactured integral with the barrel 14. In addition, the Applicant's invention is particularly applicable for a 12 gauge shotgun, although it is understood that other gauges of multi-projectile ammunition are contemplated as being covered by the present invention.

When deforming a shot pattern from its normal circular shape, kinetic energy contained in the mass of shot pellets is lost during the deformation process. In order to achieve the pattern desired for anti-personnel purposes, the choke 10 must deform the pattern as efficiently as possible because of the extreme deformation required in the shot pattern. In other words, the large transfer of vertical kinetic energy to horizontal kinetic energy must be done efficiently, because if too much kinetic energy is lost during the transfer, the pellets will not maintain enough velocity to be effective against a target. Also, the transfer of energy and deformation of the shot pattern must occur relatively smoothly because an abrupt change will provide an irregular and unpredictable pattern due to the pellets impinging off of each other. Only a fixed number of pellets exist in a given round of shot, so that for every pellet which has a primarily vertical projectile, there will be one fewer pellet in the desired horizontal projectile. Thus, great control over the pattern is an optimal consideration for anti-personnel use, because the pattern must be kept very narrow, vertically, and very wide, horizontally, to provide a reasonably uniform density of pellets in the target area. As has been shown in the prior art, it is known that a deformed shot exit will affect the pattern to a great degree. When the choke 10 restricts the interior circumference of the barrel in one direction or another, the walls of the choke 10 must be sufficiently thick to withstand the pressures without fracturing. The walls of most shotgun barrels 14 are relatively thin and would be inadequate for anything more than minor variations in the interior circumference, so the choke 10 must be thick enough itself to withstand the increased pressures due to the circumference change.

Figure 3:
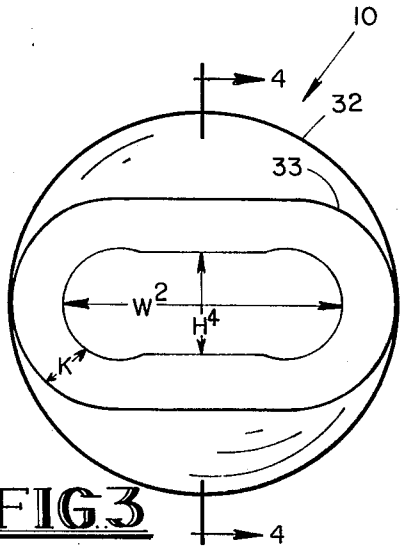
FIG. 3 is an end view of the choke at the exit end of the choke.
Figure 4:
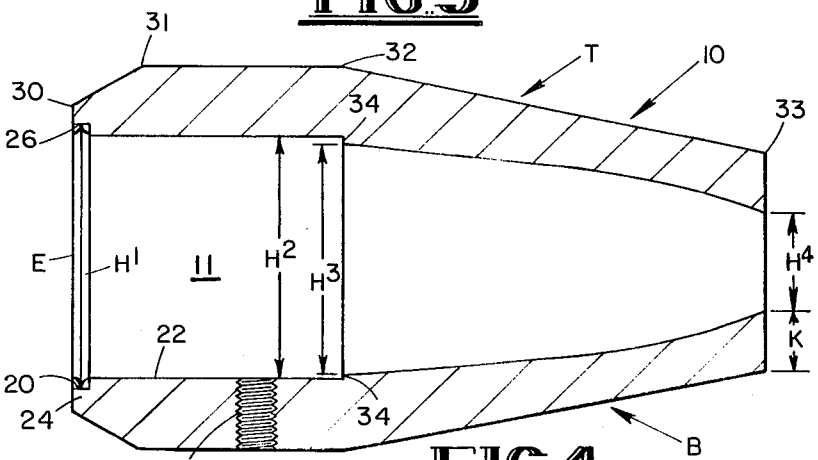
FIG. 4 is a side cross-sectional view of the choke as viewed from line 4—4 of FIG. 3.

Tests of the present invention have shown that it is capable of throwing an extremely wide and fairly uniform pattern to a maximum effective range of twenty-five yards. The width of the pattern achieved is roughly twenty-five percent of the range, while the height of the pattern achieved is roughly five percent of the range. The width and height are affected by the barrel 14 length, size of shot and type of shot. The Applicant has achieved optional results using #4 lead buckshot in a 12 gauge shotgun with a modified cylinder. At 30 feet, the pattern is approximately 21 inches high and 90 inches wide, which is over two and one half times as wide as the pattern thrown by the devices disclosed in U.S. Pat. Nos. 3,676,947 and 3,492,750. This is a significantly wider and more controlled pattern than that thrown by any other devices of which Applicant is aware, and the choke 10 does not contain the structural weakness disadvantages of the Sargeant device, mentioned earlier. The greater uniformity is thought to be achieved by the shape of the upper and lower inside sections of the choke 10. As shown in FIGS. 3 and 4, the interior 11 of the choke 10 narrows only from the top T and bottom B, while remaining of constant width $W^2$ on the sides for most of the length L of the choke 10. The height H of the choke 10 interior 11 narrows in a parabolic curve instead of a straight line tapering as it nears the exit X. Although certain types of shot and gauges of shot may be deformed adequately by a straight line tapering, it is thought that the parabolic tapering feature gives the pattern its consistency. Tests done by the Applicant with straight line tapering chokes show less control over the pattern, with the pattern thrown being essentially circular. The parabolic shape of the tapering is thought to coincide with the rate of energy transfer, just as the parabolic tendency is also found in the vertical flight path of an individual pellet when fired parallel to the ground, in the decrease in speed of an individual pellet, and other physical phenomenon associated with projectiles.

Figure 2:
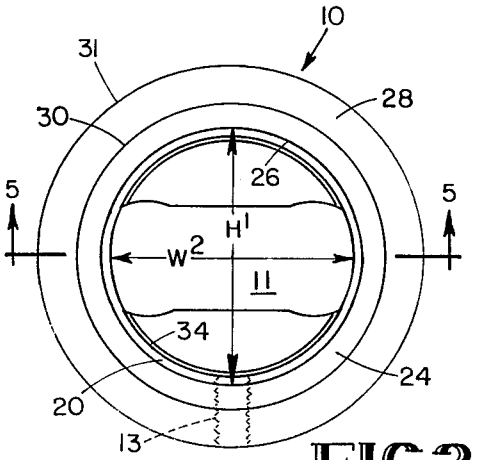
FIG. 2 is an end view of the choke viewed from the end of the choke which slides over a shotgun barrel.

The choke 10 is shown in FIG. 2 in an end view, viewing the choke 10 from the entrance end E (shown in FIG. 4), which fits over the shotgun barrel 14. The interior 11 of the choke 10 is labeled generally as 11. When viewing the choke 10 from the entrance end E as in FIG. 2, the solder channel 20 is visible. When the choke 10 is placed over the end of the gun barrel 14, the interior 11 surface of the choke 10 engages the exterior of the gun barrel 14. This part of the choke 10 interior 11 is designated the barrel slip 22 as shown in FIG. 4. A recessed flange 24 forms a solder channel 20 at the choke 10 entrance end E, because the circumference of the interior wall 26 of the recessed flange 24 is larger than the circumference of the barrel slip 22. (FIGS. 2–5 are shown without a gun barrel 14 inserted into the choke 10.) The use of the solder channel 20 will be explained hereafter.

The circumference of the exterior 28 of the choke 10 varies along the length L of the choke 10. In order to keep the weight of the choke 10 to a minimum, the circumference of the exterior 28 of the choke 10 will be less at points not critical to the design strength of the choke 10. Thus, the exterior 28 of the choke 10, as shown in FIG. 4, is milled to a relatively smaller circumference at the point 30 on the entrance end E of the choke 10. The circumference of the exterior 28 of the choke 10 linearly increases to a point 31 approximately corresponding to one third of the length of the barrel slip 22. Thus, when viewed from the entrance end E as in FIG. 2, the exterior 28 of the choke 10 is seen between points 30 and 31 only. This portion of the choke 10 from point 30 to point 31 is not subjected to stresses as extreme as other areas of the choke 10, so the walls of the choke 10 need not be as thick. The variance in circumference is more clearly shown in FIGS. 4 and 5. The exterior 28 is also milled down to provide a clearer line of sight in case it was desired to mount a sighting bead (not shown) on top T of the choke 10.

As further shown in FIG. 4, past point 31 the circumference of the exterior 28 remains constant for a period along the length L of the choke 10, and does not begin to reduce until a point 32 is reached which is approximately corresponding to the end of the barrel slip 22. Beginning at point 32, the exterior 28 of the choke 10 will shrink in circumference because the top T and bottom B of the exterior 28 of the choke 10 will approximately linearly decrease between point 32 and a point 33 at the exit X of the choke 10. The narrowing of the top T and bottom B is roughly linear along the exterior 28 between points 32 and 33 despite the fact that the interior height H decreases parabolicly, as mentioned earlier. This difference in the rate of decrease between the exterior 28 and interior 11 is acceptable, because the variation in the thickness K of the choke 10 is so minimal as to not create any significant structural weakness. Although the thickness K of the choke 10, shown in FIG. 4, will vary according to materials used, size of the barrel and gauge of the weapon, the present embodiment uses a thickness of approximately ⅛ inch from point 31 to point 33 with 4140 drawn steel as the material.

Figure 5:
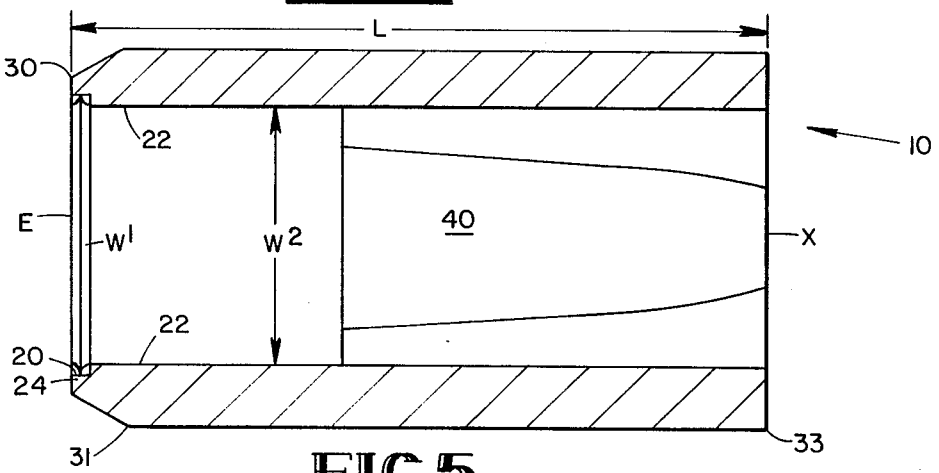
FIG. 5 is a bottom cross-sectional view of the choke as viewed from line 5—5 of FIG. 2.

Except for the solder channel 20, the interior 11 of the choke 10 varies in diameter in only one direction. As shown in FIG. 2, except for the solder channel 20, the width W of the choke interior 11 remains constant throughout the length L of the choke 10. However, the height H of the interior 11 of the choke 10 varies. Referring to FIG. 4 and 5, the variations in height H and width W will now be described. The solder channel 20 has a slightly greater height $H^1$ and width $W^1$ than the barrel slip 22. This height H is designated $H^1$ in the solder channel 20 and $H^2$ in the barrel slip 22. Similarly, FIG. 5 designates the widths to be $W^1$ in the solder channel and $W^2$ in the barrel slip 22. The height H and width W of the choke 10 interior 11 remain equal to each other throughout the solder channel 20 and barrel slip 22. A small flange, roughly corresponding to point 32 on the exterior 28 of the choke 10, provides a stop 34 for the gun barrel 14. The height $H^3$ at the stop 34 is only slightly less than the width $W^2$ of the barrel slip 22. The width W at the stop is the same as the width $W^2$ in the barrel slip 22. The size of the stop 34 should roughly correspond or be slightly less than the thickness of the walls of a standard shotgun barrel 14 to provide smooth entry of the shot pellets from the barrel 14 into the interior 11 of the choke 10. As the shot travels through the choke 10, the width $W^2$ of the choke 10 interior 11 remains constant, but beginning at the stop 34, the height H begins to gradually decrease towards the exit X. The rate at which the height H decreases is shown in FIG. 4 in a slightly exaggerated fashion. As stated earlier, Applicant has found that a high degree of control over the shot pattern is maintained if the height H decreases in a parabolic fashion from the height $H^3$ at the stop 34 to its exit height $H^4$. As shown in FIG. 5 because the width $W^2$ remains constant, the parabolic height H decrease forms a depression 40 on the top T and bottom B portions of the choke 10 interior 11 where the decreasing height H is reconciled with the constant width $W^2$.

To install on a shotgun barrel 14, it will be necessary to machine the shotgun barrel's outer diameter so that the choke 10 may slip over the outside of the barrel 14 in a relatively tight fit. The distance from the muzzle that the outer diameter of the barrel 14 must be machined will vary according to the gauge of shotgun. After slipping the choke 10 over the end of the barrel 14 and making certain that the exit X of the choke 10 is parallel to the ground, the rear of the choke 10 will be soldered to the barrel 14 with the solder being placed primarily in the solder channel 20. The present embodiment uses a 100 percent silver solder heated to approximately 1170° F., although other solders and other means of attaching the choke to the gun barrel are contemplated and well known in the art. A small set screw 13 on the bottom of the choke will be tightened onto the bottom of the barrel 14.

Although the invention defined by the following claims has been described in the foregoing embodiment, a wide variety of embodiments are contemplated by the invention. In particular, but not by way of limitation, the invention can be modified for all types of shotgun gauges, and can be manufactured as a separate piece or made integral with the shotgun barrel.

I claim:

1. A choke for effecting the projectile path of a plurality of projectiles fired substantially simultaneously from a weapon, comprising:

a tubular member;

the interior surface of said member defining a hollow, interior space through the length of the choke;

the interior surface remaining substantially constant in diameter in a first plane along the length of the choke;

the interior surface remaining substantially constant in diameter over a portion of its length and tapering substantially parabolically over the remainder of its length in a second plane;

the first plane and the second plane being substantially perpendicular to one another.

2. The choke as set forth in claim 1, wherein:

the choke is mounted on the barrel of a weapon.

3. The choke as set forth in claim 1, wherein:

the choke is integral with the barrel of a weapon.

4. The choke as set forth in claim 1, wherein:

the second plane defines the height of the interior space and the first plane defines the width of the interior space.

* * * * *